US006471261B1

(12) United States Patent
Messler

(10) Patent No.: US 6,471,261 B1
(45) Date of Patent: Oct. 29, 2002

(54) LATCHING APPARATUS

(76) Inventor: Thomas E. Messler, 5316 S. Narcissus, Broken Arrow, OK (US) 74011-4640

( * ) Notice: Subject to any disclaimer, the term of this patent is extended or adjusted under 35 U.S.C. 154(b) by 40 days.

(21) Appl. No.: 09/613,124

(22) Filed: Jul. 10, 2000

Related U.S. Application Data

(63) Continuation-in-part of application No. 09/551,387, filed on Apr. 18, 2000, which is a continuation-in-part of application No. 09/435,111, filed on Nov. 5, 1999.

(51) Int. Cl.[7] ..... E05C 3/04
(52) U.S. Cl. ..... 292/238; 292/205; 292/56
(58) Field of Search ..... 292/238, 234, 292/56, 117, 105, 205

(56) References Cited

U.S. PATENT DOCUMENTS

| | | | | |
|---|---|---|---|---|
| 409,797 A | | 8/1889 | Moore | |
| 842,735 A | | 1/1907 | Weber | |
| 1,482,652 A | | 2/1924 | Klepper | |
| 1,659,822 A | | 2/1928 | Innes | |
| 2,809,063 A | | 10/1957 | Taylor | 292/218 |
| 2,968,506 A | | 1/1961 | Lade | 292/21 |
| 3,043,617 A | | 7/1962 | Shelton | 292/6 |
| 3,697,106 A | | 10/1972 | Meyer | 292/175 |
| 4,178,025 A | * | 12/1979 | Robins | 292/117 |
| 4,451,072 A | * | 5/1984 | Petty, Sr. | 292/104 |
| 4,592,578 A | | 6/1986 | Martin | 292/40 |
| 4,690,440 A | * | 9/1987 | Rogers | 292/54 |
| 4,871,203 A | * | 10/1989 | Rogers | 292/238 |
| 4,887,854 A | * | 12/1989 | Bulten | 292/238 |
| 5,103,658 A | | 4/1992 | McQuade | 70/77 |

* cited by examiner

*Primary Examiner*—Paul N. Dickson
*Assistant Examiner*—Robert A. Siconolfi
(74) *Attorney, Agent, or Firm*—Head, Johnson & Kachigian

(57) ABSTRACT

A latching apparatus to facilitate the latching, positioning, securing, disengagement and travel of a door, window, gate or similar structure. In one exemplary embodiment of the invention, a first connecting member is attached to a first attachment structure and a latching member is pivotally attached to a second connecting member and a second attachment structure. Insertion of securing mechanisms into strategically positioned securing apertures prohibits disengagement and travel of a structure secured by the improved latching apparatus. Removal of either one of two said securing mechanisms from either side of a previously secured structure facilitates disengagement and travel of said previously secured structure.

10 Claims, 4 Drawing Sheets

LATCHING APPARATUS

REFERENCE TO PENDING APPLICATIONS

This application is a continuation-in-part application of U.S. patent application Ser. No. 09/551,387 filed Apr. 18, 2000 entitled An Improved Latching Apparatus For Doors, Gates, Windows and Similar Structures which is a continuation-in-part application of U.S. patent application Ser. No. 09/435,111 filed Nov. 5, 1999 entitled An Improved Securing Apparatus For Doors, Gates, Windows and Similar Structures.

REFERENCE TO MICROFICHE APPENDIX

This application is not referenced in any microfiche appendix.

BACKGROUND OF THE INVENTION

The present invention is directed to latching apparatuses for doors, windows, gates, or similar structures. In particular, the instant application is directed to an invention which facilitates the latching, securing, disengagement and travel of a door, window, gate or similar structure, previously secured and prohibited from unidirectional or bi-directional travel, via the insertion or removal of one or more securing mechanisms through strategically positioned securing apertures.

Latching devices, and improvements to such devices have long been the focus of improvements within the art. For instance, U.S. Pat. No. 409,797 issued to M. M. Moore on Aug. 27, 1889 discloses a gate latch which provides a gate-latch by means of which a gate hinged to swing from either or both sides is automatically locked.

U.S. Pat. No. 842,735 issued to J. A. Weber on Jan. 29, 1907 discloses a latch of a simple construction which is applicable for use at either the right or left hand side of the door or gate and which is inexpensive of production and so constructed that it cannot be manipulated by horses or other farm stock.

U.S. Pat. No. 1,482,652 issued to F. J. Klepper on Feb. 5, 1924 discloses a closure latch. This invention relates to improvements in closure latches, particularly for latches designed to be used with double hung gates which may be opened to either side.

U.S. Pat. No. 1,659,822 issued to H. C. Innes on Feb. 21, 1928 discloses a latching device for use on windows and similar structures.

U.S. Pat. No. 2,809,063 issued to L. A. Taylor on Oct. 8, 1957 discloses a gate latch, and more particularly to a gravity actuated latch for fastening a horizontally hinged gate. The principal object of this invention is to provide a gravity actuated latch for fastening a self closing hinged gate. An equally important object is to provide a gate latch having a lever which is lifted by a fixed pin carried by the free end post of a hinged gate for securing the gate. Another object is to provide a gate latch having a lever which may be manually released from either side of a closed gate. Another object is to provide a gate latch having a lever which may be manually released from either side of a closed gate. A further object is to provide a gate latch of this character which will permit a hinged gate to be released therefrom and opened in either direction. Yet another object is to provide a gate latch of this class which is provided with means for locking the latch against unauthorized entry.

U.S. Pat. No. 2,968,506 issued to K. H. Lade on Jan. 17, 1961 discloses a latch mechanism which is capable of being opened from the inside even when the latch mechanism is locked and cannot be opened from the outside.

U.S. Pat. No. 3,043,617 issued to D. L. Shelton on Jul. 10,1962 discloses a two-way closure lock which provides positive action to prevent the gate or closure from swinging past the latch stop and opening on the opposite side.

U.S. Pat. No. 3,697,106 issued to Ivan W. Meyer on Oct. 10, 1972 discloses a livestock gate latch wherein a latch is provided for use on gates to be utilized on livestock enclosures. The latch comprises in combination a latching member and a keeper. The latching member comprises a housing having a latching bolt slidably mounted therein and spring loaded in extended position. A bracket is affixed to the bolt terminating in a finger hold, the bracket and finger hold being entirely recessed within the housing to prevent actuation by animals contained within the enclosure. In an improved version, both ends of the bolt extend out of the housing and the bolt is spring biased to a median position. The bolt may be moved in either direction from the center position by grasping the finger hold, thereby permitting the latch to be used either for right-hand opening or left-hand opening doors.

U.S. Pat. No. 4,592,578 issued to Herman R. Martin on Jun. 3, 1986 discloses a positive gate latch having a striker box and two vertical catch members held in place by two sleeves secured to a base. When the catch members are down, the striker bar cannot move in either direction. The catch members are attached to an operating bar, allowing passage when activated from either direction. The gate latch may be locked in three separate positions, allowing passage in only one direction or may be locked allowing no passage in either direction. The latch is designed primarily for use on tubular structures, such as chain link fences.

U.S. Pat. No. 5,103,658 issued to Donald E. McQuade discloses a gate latch for locking a hingeably mounted gate to a latch post. A gate latch is mounted to either the gate or pose by a mounting means. The mounting means extends from a lock housing having a locking means disposed therein. Extending from the housing is an oarlock means. The oarlock means is pivotal between a first locked position and a second unlocked position. The locking means automatically locks the oarlock means in the first locked position when the oarlock pivots from the second position to the first position. Also provided is a key lock means normally biased to a locked position which may be used to unlock the oarlock from the first lock position and permit the pivotal movement of the oarlock between the first and second positions.

As can be appreciated from a review of the prior art cited herein, such art is absent disclosure, discussion, claim, or intent to disengage a latching apparatus secured on both sides of a door, gate, window or similar structure, from either side of the structure. The present invention provides an improved apparatus which provides for such disengagement.

BRIEF SUMMARY OF THE INVENTION

In accordance with the present invention an improved latching apparatus is provided which addresses the deficiencies of the prior art.

In an exemplary embodiment the apparatus includes a first connecting member attached to a first attachment structure and a second attachment member attached to a second attachment structure. A latching member is pivotally attached to the second connecting member and second attachment structure with such pivotal attachment further allowing for guided, generally horizontal travel, along a generally inclined plane via a plurality of slotted pivot guides. First and second impermanent attachments allow for the insertion of securing mechanisms, the removal of which from either side of a previously secured structure facilitates disengagement and travel of said structure. Referenced structures, without limitation, typically includes doors, gates, windows and the like.

Consequently, an object of the present invention is to facilitate disengagement and travel of a door, window, gate or similar structure, previously secured on two generally opposite surfaces, from either side of said door, window, gate or similar structure.

Another object of the present invention is to permit egress from, and access to a secured and bounded domain.

A still further object of the present invention is to provide for variable degrees of security with respect to egress from, or access to, a bounded domain.

Other objects and further scope of the applicability of the present invention will become apparent from the detailed description to follow, taken in conjunction with the accompanying drawings.

BRIEF DESCRIPTION OF THE DRAWINGS

For a more complete understanding of the features and advantages of the present invention, reference is now made to the detailed description of the invention along with the accompanying figures in which.

DETAILED DESCRIPTION OF THE PREFERRED EMBODIMENT

While the making and using of various embodiments of the present invention are discussed in detail below, it should be appreciated that the present invention provides for inventive concepts capable of being embodied in a wide variety of specific contexts. The specific embodiments discussed herein are merely illustrative of specific manners in which to make and use the invention and are not to be interpreted as limiting the scope of instant invention.

The claims and the specification describe the invention and the terms that are employed in the claims draw their meaning from the use of such terms in the specification. The same terms applied in the prior art may be broader in meaning than specifically employed herein. Whenever there is a question between the broader definition of such terms used in the prior art and the more specific use of the terms herein, the more specific meaning should be assumed.

While the invention has been described with a certain degree of particularity, it is to be noted that many modifications may be made in the details of the invention's construction and the arrangement of its components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled. The invention's general features, and apparatus components are described and disclosed in association with accompanying FIGS. 1 through 6.

Though the invention has been described in reference to illustrative embodiments, this description is not to be construed in a limiting sense. Various modifications and combinations of the illustrative embodiments as well as other embodiments of the invention will be apparent to those skilled in the art upon referencing this disclosure. It is therefore intended that this disclosure encompass any such modifications or embodiments.

Figure 1:
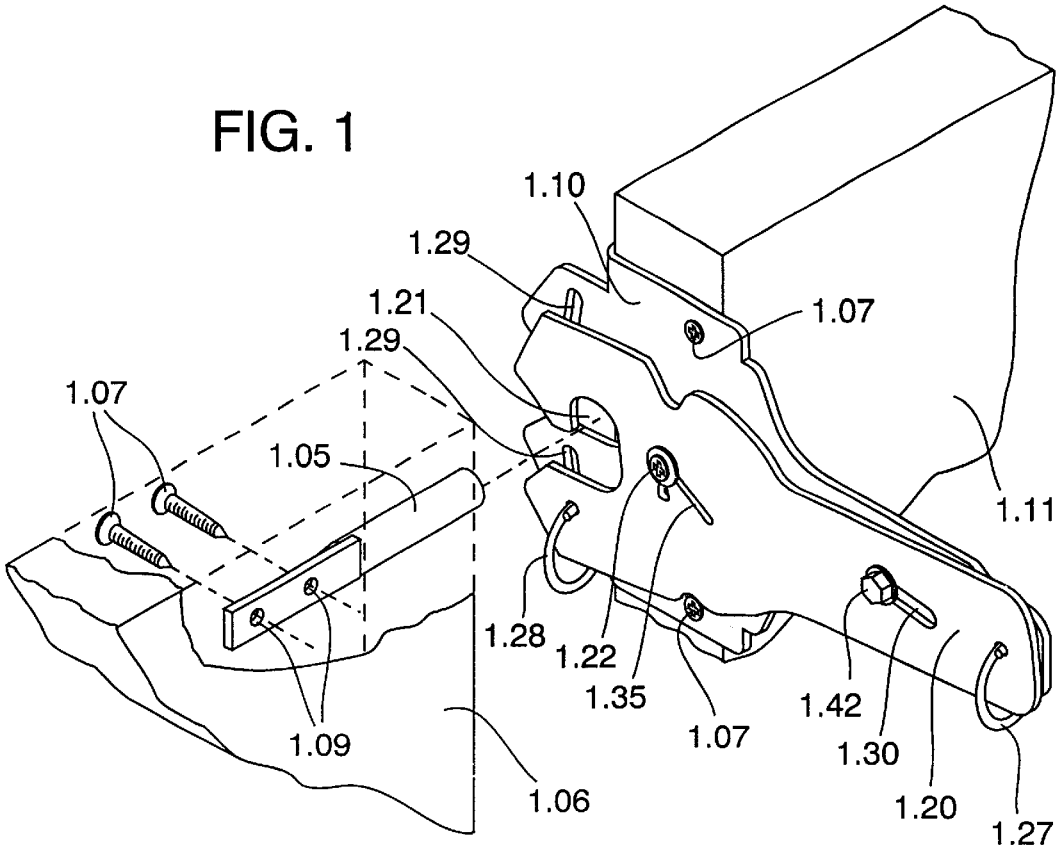
FIG. 1 is illustration of the invention as practiced it its preferred embodiment.
Figure 2:
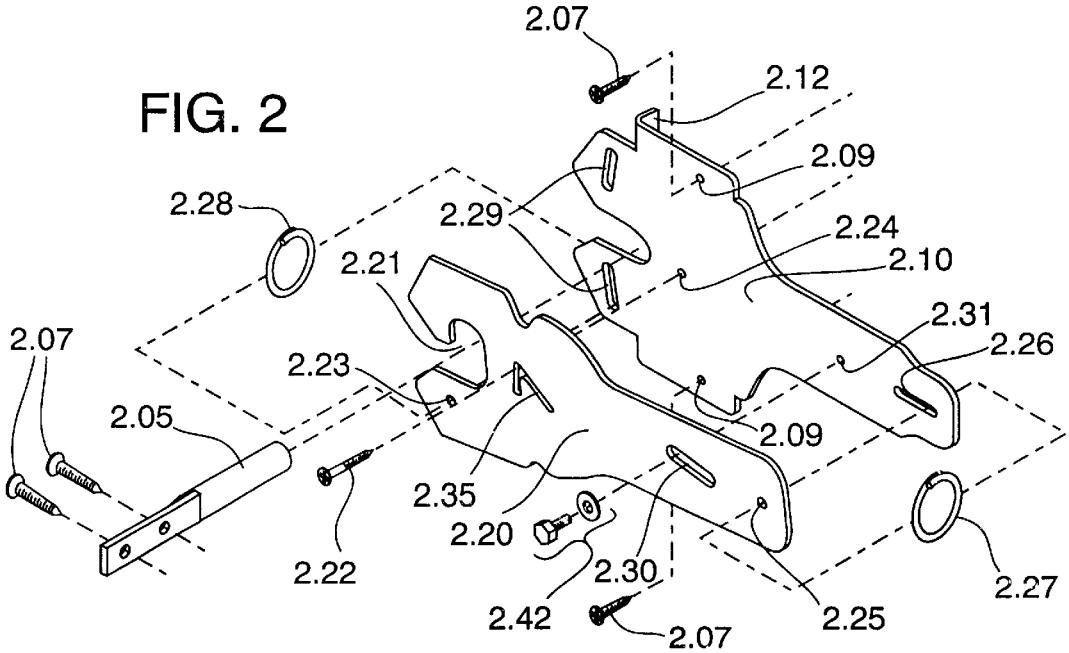
FIG. 2 is an exploded view illustration of the invention as practiced in its preferred embodiment.

The general features and preferred embodiment for an improved latching apparatus for doors, gates, windows and similar structures are shown in FIGS. 1 and 2. In FIG. 1 a first connecting member 1.05 without limitation is typically embodied as a latching bolt and is attached to a first attachment structure 1.06. A second connecting member 1.10 is attached to a second attachment structure 1.11. Without limitation, such attachment structures (1.06, 1.1 1) would include gates, gate posts, windows, window jams, window frames, door frames, doors, and other similarly purposed structures. FIG. 1 also details the attachment of said connecting members (1.05, 1.10) to said attachment structures (1.06, 1.11). Such attachment is facilitated typically by, but not limited to, bolts, screws, or similarly intended attachment devices 1.07 which are inserted through connection apertures 1.09 embodied within said first and second connecting members (1.05, 1.10). FIG. 1 further reveals a latching member 1.20 pivotally attached to said first connecting member 1.10. Said pivotal attachment is facilitated via a plurality of pivotal connections. In a first instance connection, a fastening means, including without limitation, a wood screw and washer or bolt fastening means 1.22 is inserted through a slotted pivotal guide 1.35 embodied within said latching member 1.20, through a connection aperture (not shown, further illustrated as 2.24 in FIG. 2) embodied within a second connecting member 1.10 and into a second attachment structure 1.11. Said connection allowing for both pivoting motion and travel along vertical and inclined horizontal plane axis influenced by the structure and design of said slotted pivotal guide 1.35. A second pivotal attachment is facilitated via a bolting or other similarly intended fastening means 1.42 inserted through a slotted pivotal guide 1.30 embodied within said latching member 1.20 through a pivotal connection aperture (not shown, further illustrated as 2.31 in FIG. 2). Said slotted pivot guide 1.30 also positioned to influence lateral travel along a general inclined plane range of motion. As easily envisioned, an alternative pivotal connection can be had by simply providing slotted pivoted guides (1.35, 1.30) to be embodied within the second connecting member 1.10 and pivotal connecting guides (represented as 2.31, 2.34 in FIG. 2) embodied within the body of the latching member 1.10. FIG. 1 also illustrates securing mechanisms 1.27, 1.28 inserted through securing apertures embodied within latching member 1.20 and second connecting member 1.10. Further discussion and detail orientation of such securing mechanisms 1.27, 1.28 and securing apertures will be presented in association with FIG. 2.

As illustrated in FIG. 1, latching member 1.20 provides for a first connecting member grapple 1.21 to position said first connecting member 1.05 when the invention is practiced in its secured configuration. FIG. 2 provides additional detail with respect to the invention's interrelating components. Turning now to FIG. 2.

As can be seen in FIG. 2, a securing mechanism 2.27 is inserted through a securing aperture 2.25 in latching member 2.20 and a securing aperture 2.26 which is generally positioned along a horizontal inclined plane and embodied within said second connecting member 2.10. A second securing mechanism 2.28 is inserted through a securing aperture 2.23 embodied within said latching member 2.20 and a securing aperture 2.29 positioned along a generally vertical plane and embodied within said second connecting member 2.10. In FIG. 2 a second securing aperture 2.29 lying along a generally vertical plane and embodied within said second connecting member 2.10 can also be observed. Said second occurrence of securing aperture 2.29 allows for instances wherein the latching mechanism of the instant invention requires a reverse direction mounting to allow for positioning, securing, disengagement and travel of a door, window, gate or similar structure. Simply reversing the position of said second attachment structure 2.10, latching member 2.20 and first connecting member 2.05 will facilitate proper attachment of the instant invention in circumstances where required. FIG. 2 further illustrates the proper positioning and insertion of a pivotal fastening means 2.42 through a slotted pivot guide 2.30 embodied within latching member 2.20 and connecting a second connecting member 2.10 via connecting aperture 2.31 embodied within said second attachment structure. A second pivotal attachment can be observed via fastening means 2.22 insertion through slotted pivotal guide 2.35, and through a second connecting aperture 2.24 embodied within said second connecting member 2.10. In FIG. 2, the invention's first connecting member's 2.05 intended secured position can be visualized as secured by the invention's first connecting member grappled 2.21. Also as shown in FIG. 2 are positioning fingers 2.12 used to brace and position said second connecting member 2.10 against said second attachment structure (not shown, referenced as 1.11 in FIG. 1).

Figure 3:
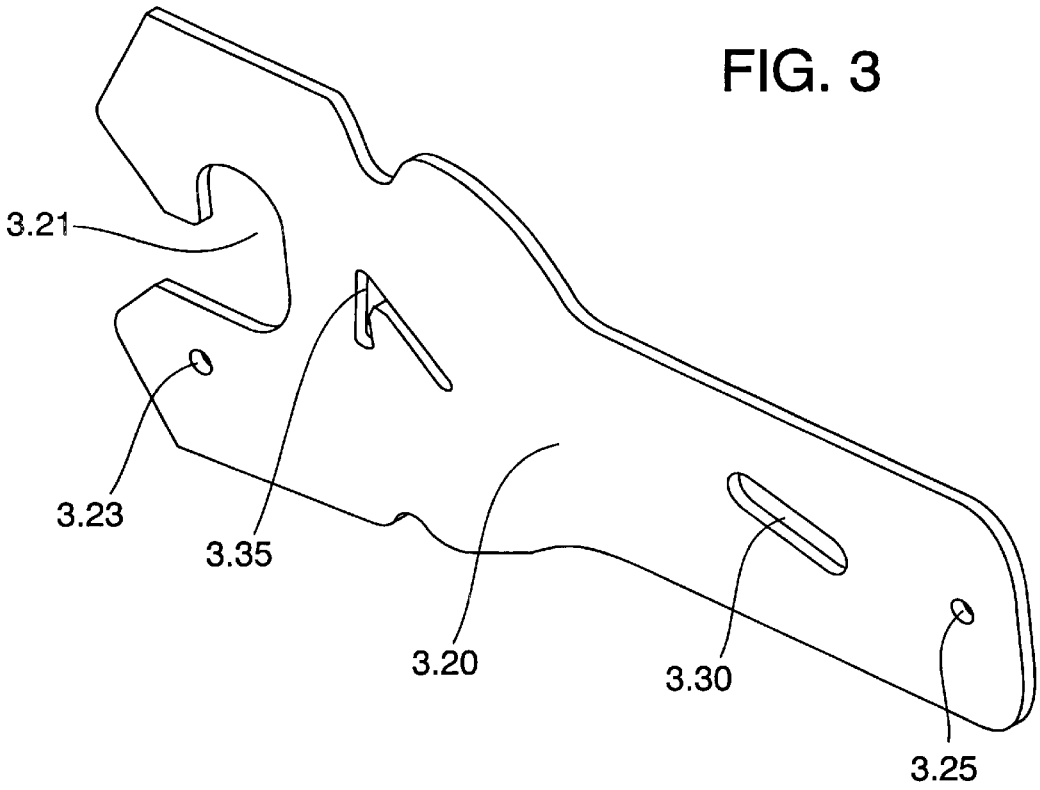
FIG. 3 is an illustration providing first side detail of the invention's latching member.

FIG. 3 provides greater detail with respect to the invention's latching member. Turning now to FIG. 3.

Figure 4:
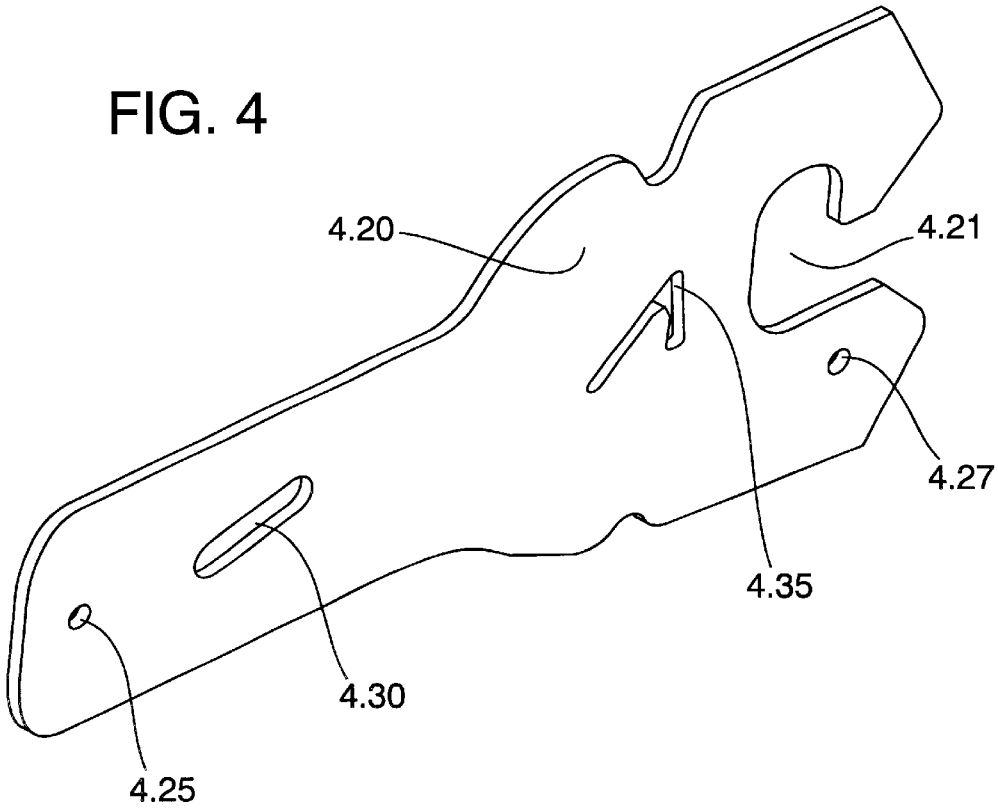
FIG. 4 is an illustration providing second side detail of the invention's latching member.

As shown in FIG. 3, the invention's first connecting member grappled 3.21 is clearly illustrated as are securing apertures 3.23, 3.25. Slotted pivotal guides 3.30, 3.35 are clearly shown evidencing generally inclined and vertical orientations. FIG. 4, for purposes of illustration, provides an opposite side view of said latching member wherein slotted pivotal guides are represented as 4.30 and 4.35, securing apertures are noted as 4.25 and 4.27, and the invention's first connecting member grappled is designated as 4.21.

Figure 5:
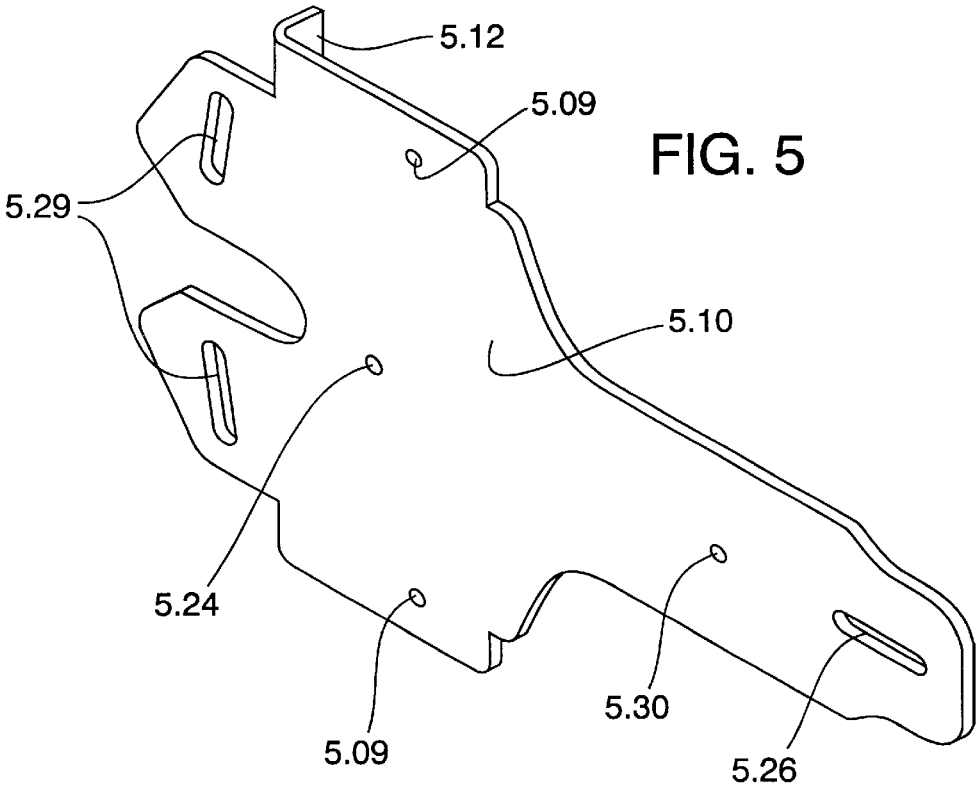
FIG. 5 is an illustration providing first side detail of the invention's second connecting member.
Figure 6:
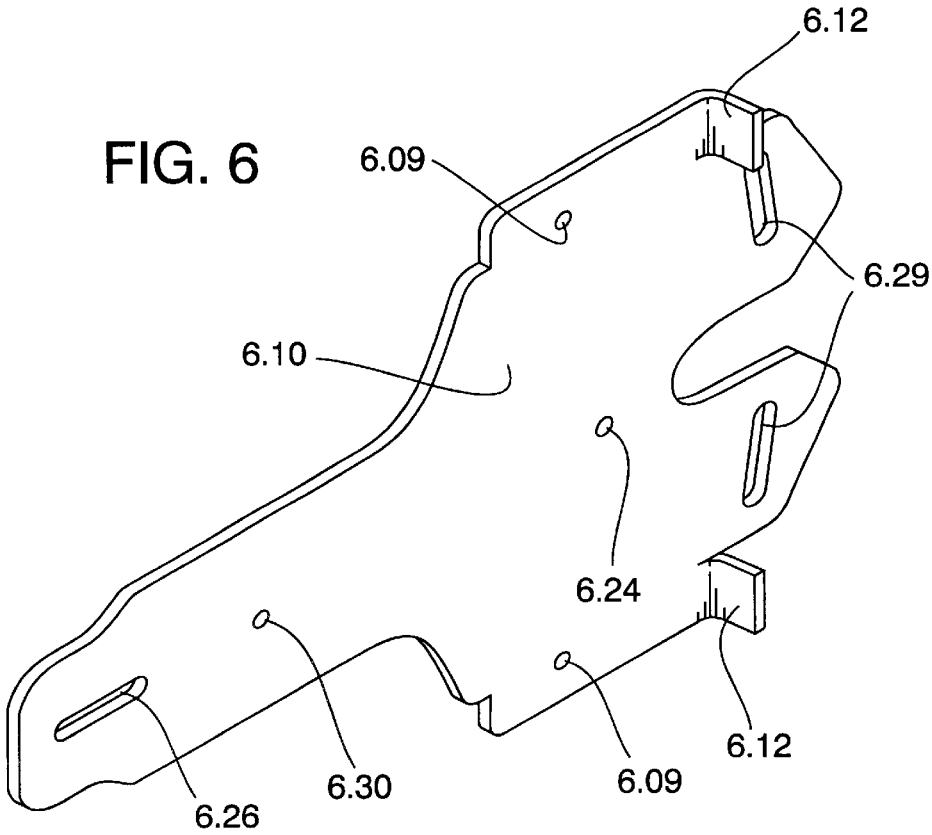
FIG. 6 an illustration provide second side detail of the invention's second connecting member.

FIG. 5 provides greater detail with respect to the invention's second connecting member. In FIG. 5 securing aperture 5.29 is noted. As discussed previously, replicated securing apertures 5.29 are positioned on a generally vertical orientation are provided within the body of the second connecting member 5.10 to facilitate applications where a reverse direction mounting application is required. Also shown in FIG. 5 is the invention's uppermost positioning finger 5.12 as well as securing aperture 5.26. Connecting apertures 5.09 are illustrated and further allow for the insertion of the connection means to attach said second connecting member 5.10 to a second attachment structure. A second connecting aperture 5.24 is shown in FIG. 5. FIG. 6 illustrates further detail and provides an opposite side view of the second connecting member. Turning now to FIG. 6.

Figure 7:
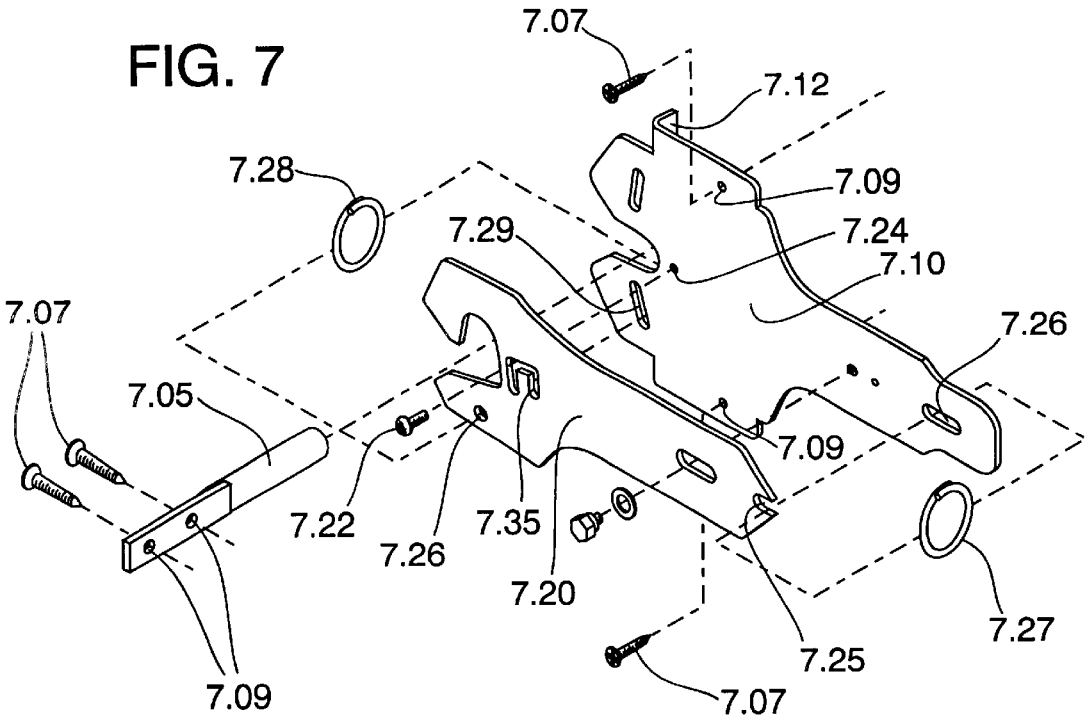
FIG. 7 is an exploded view illustration of the invention as practiced in an alternative embodiment.

In FIG. 6 the invention's positioning fingers 6.12 are clearly illustrated as are the invention's vertically oriented securing apertures 6.29 and horizontal oriented securing apertures 6.26 and a second connecting aperture 6.24. FIG. 7 illustrates an alternative embodiment of the present invention. Turning now to FIG. 7.

Figure 8:
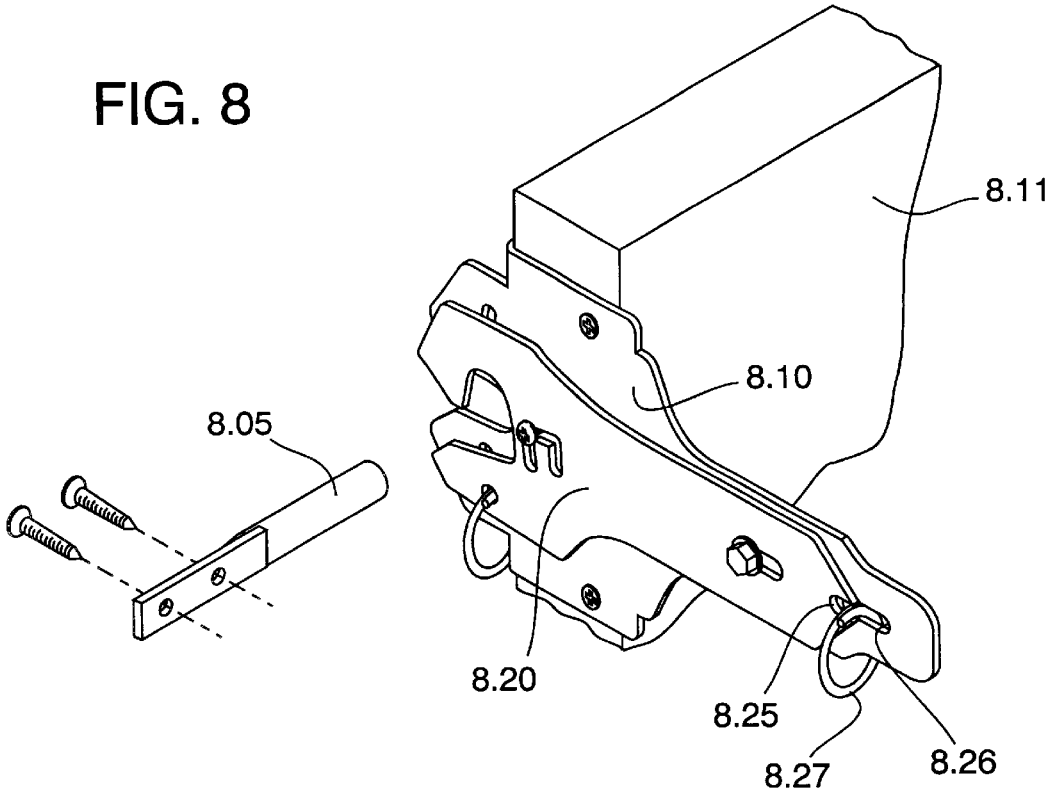
FIG. 8 is a configured illustration of the alternative embodiment noted in FIG. 7.

FIG. 7 illustrates an exploded view illustration of the invention as practiced in an alternative embodiment. In FIG. 7 a first connecting member 7.05 and second connecting member 7.10 are shown and are of essentially similar structures to that provided for an discussed in association with similarly named structures of FIGS. 1 through 6. FIG. 7 also denotes connection apertures 7.09 through which attachment devices 7.07 may be inserted to facilitate attachment of said first connecting member 7.05 to a first attachment structure (not shown) and attachment of said second connecting member 7.10 to a second attachment structure (not shown), said attachment structures illustrated and discussed in association with FIGS. 1 through 6. FIG. 7 further illustrates a latching member 7.20 pivotally attached to said second connecting member 7.10, said pivotal attachment facilitated via a plurality of pivotal connections. In a first instance connection a pivotal fastening means including, without limitation, a wood screw and washer or bolt fastening means 7.22 is inserted through a slotted pivotal and positioning guide 7.35 embodied within said latching member 7.20 and through a pivotal connection aperture 7.24 embodied within said second connecting member 7.10. To facilitate securing or de-securing the present invention from its secured configuration, insertion of securing mechanisms 7.27, 7.28 is facilitated via securing apertures 7.26 and 7.29 embodied within said second connecting member 7.10 and a securing aperture 7.23 embodied within said latching member 7.20. The latching member 7.20 of the alternative embodiment illustrated in FIG. 7 provides a securing guide 7.25 embodied within said latching member as opposed to a second securing aperture as previously discussed and disclosed in association with FIGS. 1 through 6. Also described and illustrated in FIG. 7 is a partial view of one of the invention's positioning fingers 7.12 embodied as part of said second connecting member 7.10. FIG. 8 is a configured illustration of alternative embodiment as discussed in association with FIG. 8 further illustrates a second attachment structures 8.1 wherein the invention's fastening mechanism 8.27 is shown positioned within the securing guide 8.25 of the latching member 8.20 and inserted through the securing aperture 8.26 of the second connecting member 8.10.

While this invention has been described to illustrative embodiments, this description is not to be construed in a limiting sense. Various modifications and combinations of the illustrative embodiments as well as other embodiments will be apparent to those skilled in the art upon referencing this disclosure. It is therefore intended that this disclosure encompass any such modifications or embodiments.

What is claimed is:

1. An improved latching apparatus secured on both sides of a gate, door, window or similar structure allowing disengagement and travel of said previously secured structure upon removal of either one of two securing mechanisms comprising:

a first connecting member attached to a first attachment structure;

a second connecting member attached to a second attachment structure;

a latching member attached to said second connecting member via a sliding pivotal attachment means;

a first connecting member grapple integrated within said latching member;

a first side impermanent attachment of said second connecting member to said latching member; said first side attachment facilitated via the insertion of a securing mechanism means through securing apertures embodied within said second connecting member and said latching member; and a second side impermanent attachment of said second connecting member to said latching member; said second side attachment facilitated via the insertion of a securing mechanism means through securing apertures embodied within said second connecting member and said latching member which are distinct from securing apertures utilized in said first side impermanent attachment.

2. The improved latching apparatus of claim 1 wherein said latching member's sliding pivotal attachment to said second connecting member is facilitated via a plurality of slotted pivot guides; said guides positioned to allow travel of said latching member along substantially horizontal and vertical planes.

3. The improved latching apparatus of claim 1 wherein said second impermanent attachment of said second connecting member to said latching member is facilitated via a slot shaped securing aperture of generally horizontal orientation embodied within said second connecting member.

4. The improved latching apparatus of claim 1 wherein said second impermanent attachment of said second connecting member to said latching member is facilitated via a slot shaped securing aperture of generally horizontal orientation embodied within said latching member.

5. The improved latching apparatus of claims 1 wherein said first connecting member is a striking bar.

6. The improved latching apparatus of claim 1 wherein said first connecting member's attachment to said first attachment structure member is facilitated via the insertion of connecting means through a plurality of connection apertures embodied within said first connecting member.

7. The improved latching apparatus of claim 1 wherein said second connecting member's attachment to said second attachment structure is facilitated via the insertion of connecting means through a plurality of connection apertures embodied within said second connecting member.

8. The improved latching apparatus of claim 1 further comprising at least one positioning finger.

9. The improved latching apparatus of claim 1 wherein said first impermanent attachment of said connecting member to said latching member is facilitated via a slot shaped securing aperture of generally vertical orientation embodied within said second connecting member.

10. The improved latching apparatus of claim 1 wherein said first impermanent attachment of said second connecting member to said latching member is facilitated via a slot shaped securing aperture of generally vertical orientation embodied within said latching member.

* * * * *